US006319046B1

(12) United States Patent
Feye-Hohmann et al.

(10) Patent No.: US 6,319,046 B1
(45) Date of Patent: Nov. 20, 2001

(54) ELECTRICAL CONNECTION UNIT WHICH CAN BE USED WITH BOTH INSULATED AND STRIPPED LEADS

(75) Inventors: Jürgen Feye-Hohmann, Detmold; Gunther Löhmann, Wangen; Klaus Schadhauser, München, all of (DE)

(73) Assignees: Phoenix Contact GmbH & Co., Blomberg; Patent-Treuhand-Gesellschaft fur elektrische Gluhlampen mbh, Munich, both of (DE)

( * ) Notice: Subject to any disclaimer, the term of this patent is extended or adjusted under 35 U.S.C. 154(b) by 0 days.

(21) Appl. No.: 09/315,969

(22) Filed: May 21, 1999

(30) Foreign Application Priority Data

May 22, 1998 (DE) ..... 198 22 958
Jun. 23, 1998 (DE) ..... 198 27 963

(51) Int. Cl.[7] ..... H01R 4/24; H01R 4/26; H01R 11/20

(52) U.S. Cl. ..... 439/395; 439/409

(58) Field of Search ..... 439/441, 439, 439/406, 395, 397, 404, 398, 400, 401

(56) References Cited

U.S. PATENT DOCUMENTS 4,153,324 * 5/1979 Kukla ..... 439/397
4,385,794 * 5/1983 Lucius ..... 439/399
4,464,003 * 8/1984 Goodman et al. ..... 439/404
4,494,813 * 1/1985 Daley Jr., et al. ..... 439/404
5,078,616 * 1/1992 Nemcovsky ..... 439/404
5,662,493 * 9/1997 Reichle ..... 439/409
5,860,829 * 1/1999 Hower et al. ..... 439/417
5,954,533 * 9/1999 Hatagishi et al. ..... 439/397
6,004,169 * 12/1999 Wu ..... 439/856

FOREIGN PATENT DOCUMENTS 25 36 184 8/1975 (DE) .
40 27 772 9/1990 (DE) .
0 419 301 8/1990 (EP) .

OTHER PUBLICATIONS

Wago Kontaktechnik GmbH, A Page of Product Catalog, Sep., 1998.

* cited by examiner

*Primary Examiner*—Brian Sircus
*Assistant Examiner*—Michael C. Zarroli
(74) *Attorney, Agent, or Firm*—Nixon Peabody LLP; David S. Safran

(57) ABSTRACT

An electrical connection unit including a housing with at least one terminal for receiving either an insulated lead or a stripped lead and at least one metal part having a cutting element and a spring element. The cutting element and the spring element are located along a longitudinal extension of the lead thereby minimizing the height of the electrical connection unit such that it may be used in confined spaces. In accordance with one embodiment, the cutting element and the spring element coincide in space such that they are substantially coplanar to further reduce the size of the electrical connection unit. In accordance with one embodiment of the present invention, the metal part serves a dual function as a cutting element and also as a spring element and has an essentially box-shaped configuration. The housing may also include catch projections and/or attachment cross pieces to retain the metal part in the housing. Furthermore, a mountable thrustor and /or latchable cover may also be provided.

18 Claims, 9 Drawing Sheets

ELECTRICAL CONNECTION UNIT WHICH CAN BE USED WITH BOTH INSULATED AND STRIPPED LEADS

BACKGROUND OF THE INVENTION

1. Field of the Invention

The present invention relates to an electrical connection unit for establishing an electrically conductive contact with an insulated lead or a stripped lead. In particular, the present invention relates to such an electrical connection unit where the metal part functions as a contact element that cuts the insulation of the insulated lead when the insulated lead is inserted.

2. Description of the Related Art

For many years, there have been various electrical connection units including terminals to which electrical leads can be easily connected without prior stripping of the insulation from an electrically conductive core. To accomplish this, the insulated lead is inserted into a lead receiver of the terminal and then pressed into a cutting element by which the insulation of the lead is cut through and the core of the lead is contacted with the cutting element. There are numerous embodiments of these types of terminals for the connection of insulated leads. These numerous embodiments generally differ in how the lead inserted into the lead receiver is pressed into the cutting element. By using these terminals, a significant time advantage and savings may be attained in the connection of leads since the preparation and stripping of the electrical leads are eliminated. Of course, there have been other types of electrical connection units, which have been known for many decades, that include terminals for connecting stripped electrical leads.

A product catalog of the company WAGO Kontakttechnik, GmbH. discloses an electrical connection unit of the initially mentioned type. This electrical connection unit includes both the cutting elements and also the spring element so that both insulated leads and also stripped leads can be connected to the connection unit. However, this disclosed electrical connection has a significant disadvantage in that due to the arrangement of the cutting elements in a separate plane above the spring element, the connection unit has relatively large dimensions, in particular, a very large height dimension. This large dimension is a very significant disadvantage because the relatively large size of the electrical connection unit limits its application and prevents its use in confined spaces where the simplified use of such electrical connection units is especially desirable.

In particular, the continuous reduction in the size of the circuit boards themselves and the miniaturization of the components located on the circuit board has required that electrical connection units located on the circuit board to have very small dimensions. In addition, there are numerous other applications in which electrical connection units with very small dimensions are necessary due to the very small availability of the connection space, such as when leads are being installed. Thus, there exists an unfulfilled need for such an electrical connection unit which can be used with both insulated and stripped leads but also having very small dimensions such that the electrical connection unit may be used in confined spaces.

SUMMARY OF THE INVENTION

One object of the present invention is to provide an electrical connection unit which can be used with both insulated and stripped leads.

Another object of the present invention is to provide such an electrical connection unit having very small dimensions such that the electrical connection unit may be used in confined spaces.

The above noted objects are achieved by providing an improved electrical connection unit including a metal part having both, the cutting element, and also the spring element which are located substantially coplanar along a longitudinal extension of the lead. Because the cutting element and the spring element are located in the longitudinal extension of the lead and not on top of one another, as in the prior art, the height of the electrical connection unit can be greatly reduced. This allows the use of the electrical connection unit in confined spaces such as on a circuit board.

In one embodiment of the electrical connection unit in accordance with the present invention, the cutting element and the spring element is simply one metal part. This reduces the number of components which form the electrical connection unit, while also allowing a simple and quick production of the connection unit. When the cutting element and the spring element are made in one piece in accordance with this embodiment, the metal part which implements the cutting element and the spring element, can be easily inserted into the housing. If necessary, the metal part can be retained in the housing by a corresponding catch means in the housing.

According to another embodiment of the electrical connection unit in accordance with the present invention, the cutting element and the spring element coincide in space such that they are substantially coplanar. In this way, a further reduction in size of the connection unit is made possible. In addition, the production of the connection unit is also further simplified. The metal part in this embodiment may be box-shaped and include laterally elastic legs. The free ends of the laterally elastic legs may be provided with cutting edges for making contact with an insulated lead. The box-shaped metal part and the resulting overall box-shaped configuration of the connection unit enables a very simple arrangement of several connection units in a row to serve as a terminal block. Furthermore, such metal part can be manufactured very easily, for example, by stamping.

These and other objects, features and advantages of the present invention will become more apparent from the following detailed description of the preferred embodiments of the invention when viewed in conjunction with the accompanying drawings.

DETAILED DESCRIPTION OF THE INVENTION

Figure 1:
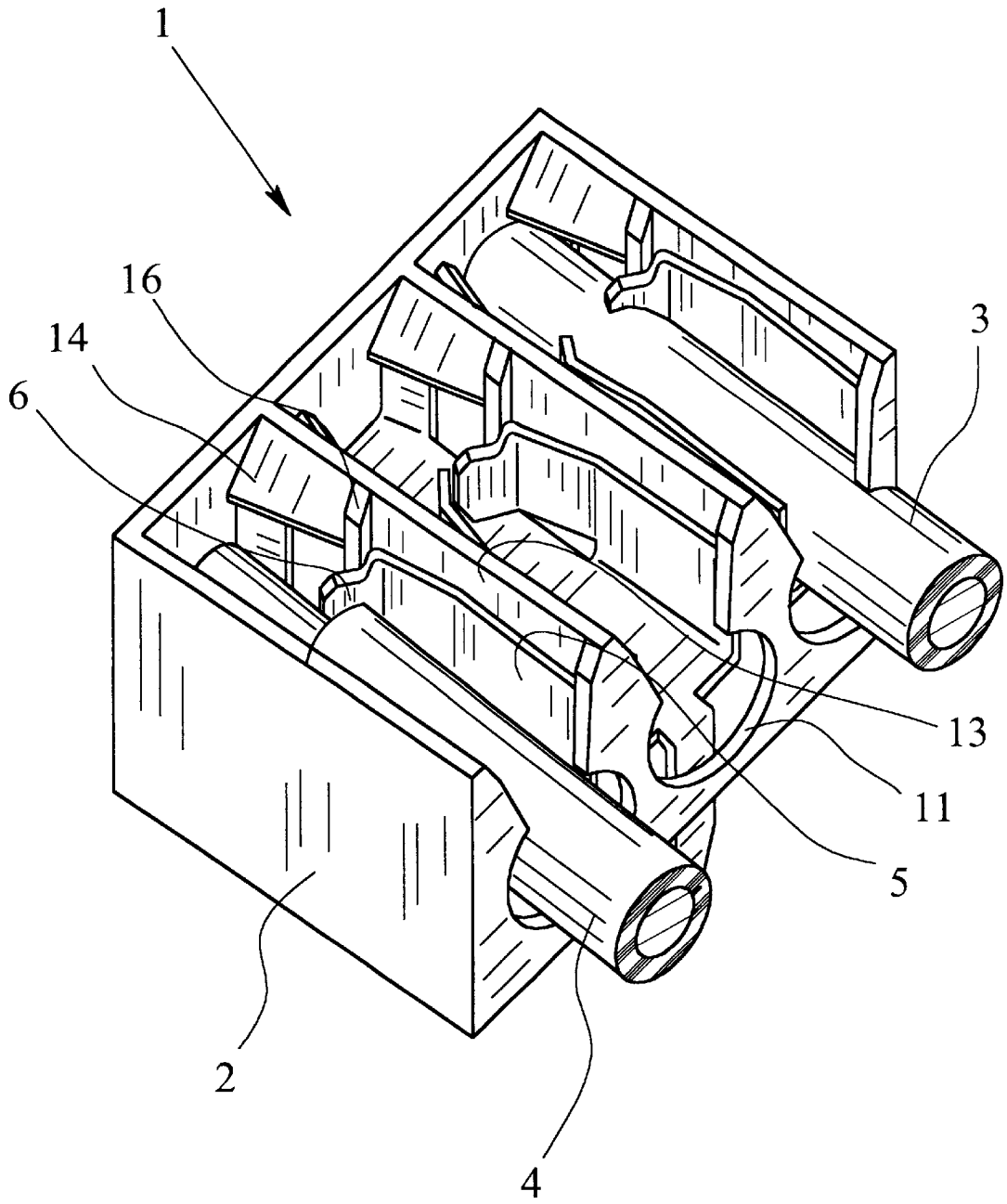
FIG. 1 shows perspective view of an electrical connection unit in accordance with one embodiment of the present invention with an insulated lead and a stripped lead connected therein.

FIG. 1 clearly illustrates an electrical connection unit 1 in accordance with one embodiment of the present invention which can be used with both insulated and stripped leads and which also has very small dimensions such that the electrical connection unit 1 may be used in confined spaces. The illustrated embodiment of the electrical connection unit 1 of FIG. 1 includes a housing 2 which has a total of three terminals. Segments of both an insulated lead 3, and also a stripped lead 4, are illustrated as being connected to the electrical connection unit 1. However, it should be noted that the insulated lead 3 and stripped lead 4 are shown for clarification purposes in this figure as well as the other figures and is not intended to be an aspect of the present invention. It is also important to recognize that whereas an insulated lead 3 is illustrated as being installed in one terminal and a stripped lead 4 is illustrated as being installed in another terminal, all of the illustrated terminals can connect either an insulated lead 3 or a stripped lead 4. Consequently, the third terminal of the electrical connection unit 1 as shown in FIG. 1 which is still free (i.e. a lead is not installed) may be used to connect either an insulated lead 3 or a stripped lead 4. In addition, it should also be recognized that whereas in the present embodiment, the electrical connection unit 1 having three terminals is shown, different number of terminals may be provided in accordance with the use and application. For instance, a few as one terminal may be provided in the electrical connection unit 1 or many more terminals may be provided. In the following discussion of FIGS. 1 to 9 which illustrate various embodiments of the present invention, common elements/aspects of the invention are enumerated using like numerals to more fully and accurately describe the invention being described and claimed.

Figure 2:
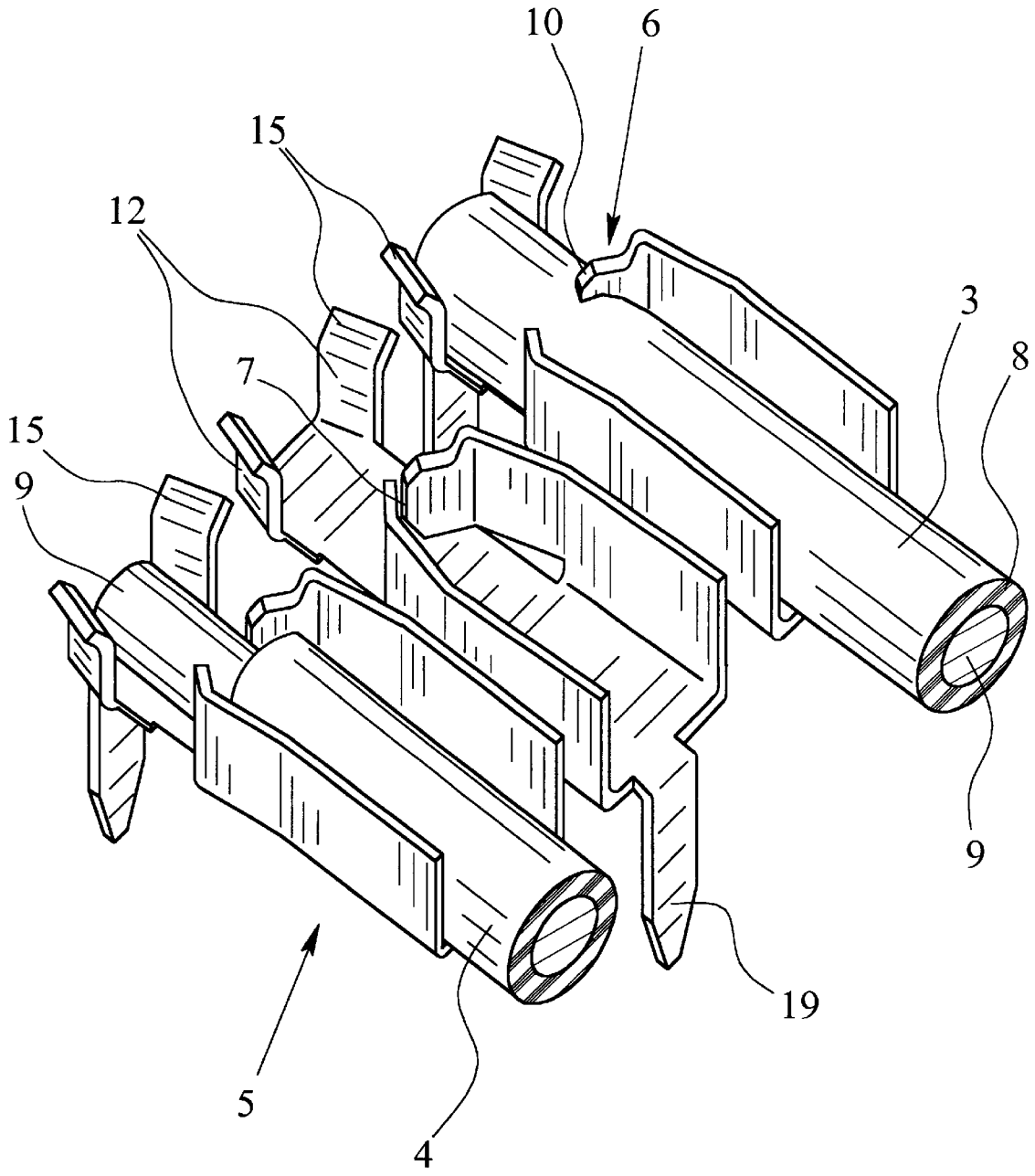
FIG. 2 shows a perspective view of the metal parts of the electrical connection unit of FIG. 1 without the housing.

FIG. 2 more clearly illustrates metal part 5 of the electrical connection unit 1 of FIG. 1 with the housing 2 which surrounds the metal part 5 not being illustrated in FIG. 2. Since the electrical connection unit 1 as shown in FIG. 1 has a total of three terminals in the housing 2, FIG. 2 illustrates a total of three metal parts 5 together with the segments of the insulated lead 3 and the stripped lead 4. Here, each metal part 5 is made essentially in a box-shape and is provided with laterally elastic legs 6. The two free ends in front of the laterally elastic legs 6 are made as cutting edges 7. Thus, the metal part 5 serves the function of a cutting element for cutting through the insulation 8 of an insulated lead 3 and subsequently making electrically conductive contact with the core 9 of the lead 3, and also serves the function of a spring element which makes electrically conductive contact with a stripped lead 4 as will be described in further detail below. The laterally elastic legs 6 of the metal part 5 are made such that they form a contact opening which runs obliquely relative to the longitudinal extension of the leads 3 and 4. In this regard, in the area of the cutting edges 7, the laterally elastic legs 6 form an entry area 10 which is tapered downward and runs transversely to the longitudinal extension of the insulated lead 3. These laterally elastic legs 6 of the metal part 5 allow the electrical connection unit 1 in accordance with the illustrated embodiment of the present invention to be used with both insulated leads 3 and stripped leads 4.

To establish an electrically conductive contact with an insulated lead 3, the insulated lead 3 is initially aligned parallel to the metal part 5 from overhead (i.e. outside the metal part 5). It should be noted that in the illustrated embodiment, the box-shaped metal part 5 has a longitudinal dimension such that the insulated lead 3 is aligned parallel to this longitudinal dimension of the metal part 5. Then, the insulated lead 3 is pressed into the metal part 5 from its overhead position so that the cutting edges 7 cut through the insulation 8 of the insulated lead 3 and make contact with the core 9. To establish an electrically conductive contact with a stripped lead 4, the stripped lead 4 is pushed through an opening 11 formed in the housing 2 substantially perpendicular to the longitudinal dimension of the metal part 5 into the electrical connection unit 1 as illustrated in FIGS. 1 and 2. When the stripped lead 4 is pushed through the opening 11, the core 9 of the stripped lead 4 initially contacts the laterally elastic legs 6. As the stripped lead 4 is pushed further, the core 9 of the stripped lead 4 pushes apart the laterally elastic legs 6 such that the core 9 passes through the contact opening formed by the laterally elastic legs 6. Of course, the laterally elastic legs 6 are in contact with the core 9 of the stripped lead 4 in the fully installed position thereby establishing an electrically conductive contact between the core 9 and the laterally elastic legs 6 of the electrical connection unit 1. It should also be noted that whereas various different embodiments of the present invention is disclosed below, the electrically conductive contacts may be established in these different embodiments operate in essentially the same manner as the above described embodiment.

On one end of the metal part 5 away from the opening 11 of the housing 2, a metal clip 12 which is open upwardly may also be provided. The metal clip 12 may be used to position the metal part 5 in the housing 2 as shown in FIG. 1. In this regard, two catch projections 14 may be formed as shown in FIG. 1 on the inner side walls 13 of the housing 2, such that the ends 15 of the metal clip 12 catch underneath the catch projections 14. Since the metal clip 12 is also made to be elastic, the metal part s can be easily pressed from overhead into the housing 2 during the manufacturing of the electrical connection unit 1. As another axial attachment and positioning aid, attachment crosspiece 16 may also be formed on the inner side walls 13 of the housing 2 as shown in FIG. 1. The attachment crosspieces 16 prevent axial displacement of the metal part 5 when a stripped lead 4 is pushed into the electrical connection unit 1. In this manner, when an insulated lead 3 or a stripped lead 4 is removed from the electrical connection unit 1 by lifting up the lead 3 or 4 out of the housing 2, the metal part 5 is retained in the housing 2 by the ends 15 of the metal clip 12 which are retained under the catch projections 14. Furthermore, in addition to retaining the metal part 5 in the housing 2, the metal clip 12 may also be used as an additional receiver and support for either the insulated lead 3 or the stripped lead 4 when these leads are connected to the electrical connection unit 1. Because the metal clip 12 is made to be elastic, it can accommodate both the thicker end of an insulated lead 3 and also the thinner end of a stripped lead 4, in effect, the core 9.

Figure 3:
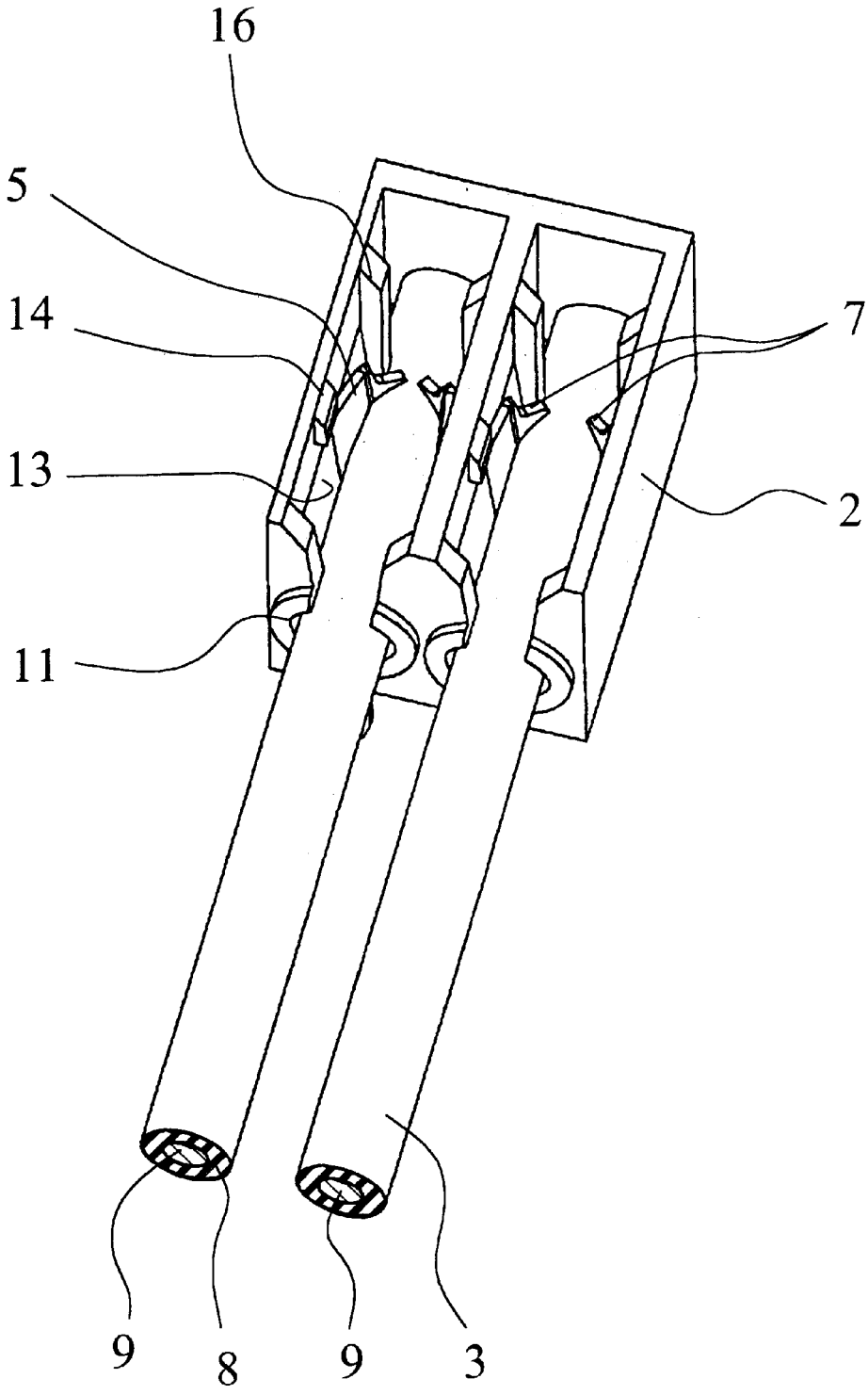
FIG. 3 shows a perspective view of an electrical connection unit in accordance with a second embodiment of the present invention with two connected insulated leads connected therein.
Figure 4:
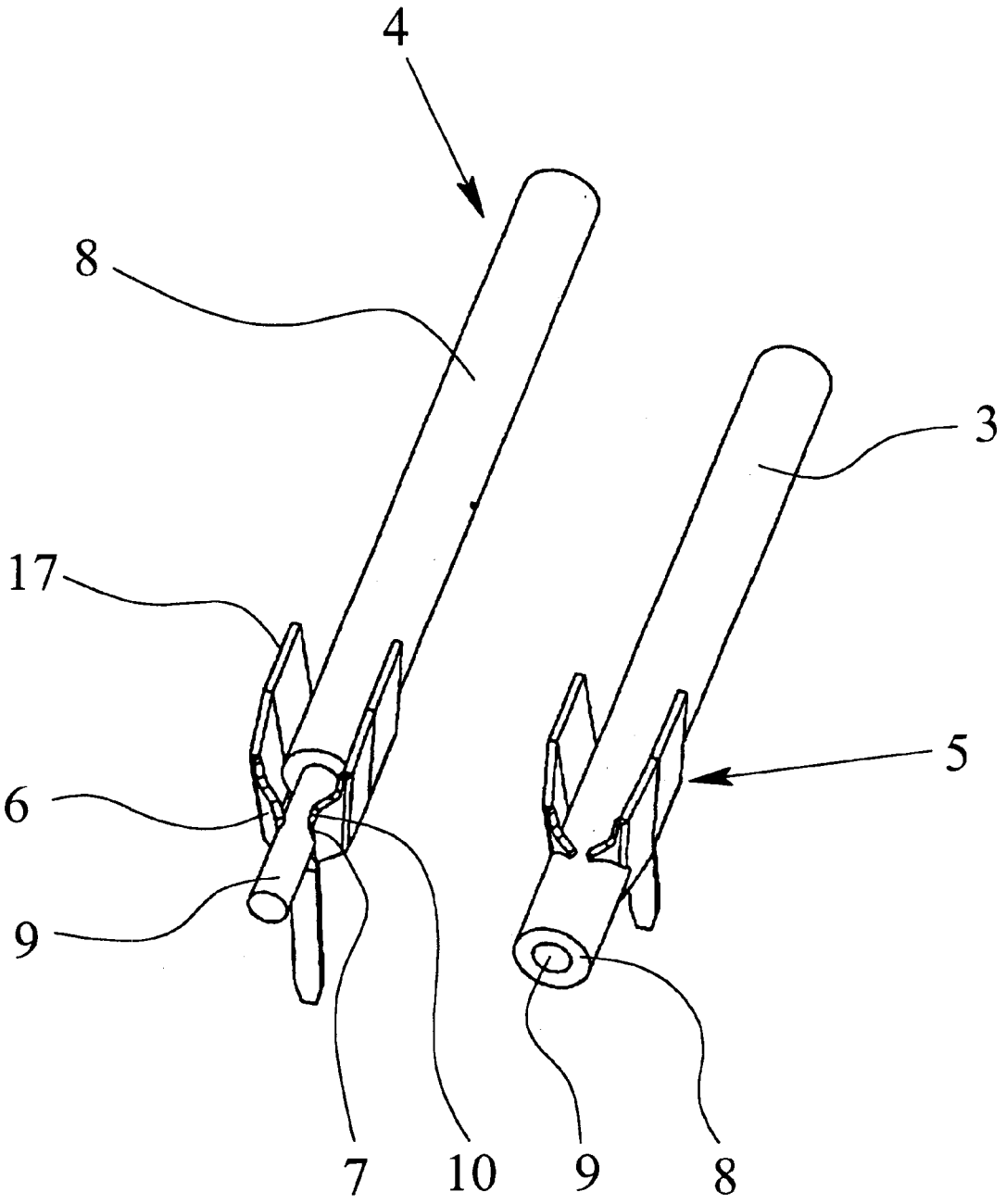
FIG. 4 shows a perspective view of an alternative embodiment of the metal part of FIG. 2 in accordance with the present invention.

FIGS. 3 and 4 show a second embodiment of an electrical connection unit 1 in accordance with the present invention with common elements/aspects of the invention being enumerated using like numerals. FIG. 4 shows only the metal parts 5 with a connected insulated lead 3 or a connected stripped lead 4. In contrast to the metal parts 5 in the first embodiment of FIG. 2, the metal parts 5 as shown in the second embodiment of FIG. 4 do not have metal clips 12. Otherwise, these metal parts 5 are substantially the same as those previously disclosed. The metal parts 5 are retained in the housing 2 in the present embodiment by catch projections 14 which are located on the inner side walls 13 of the housing 2. These catch projections 14 fit over a corresponding catch formation 17 of the metal part 5 which is most clearly shown in FIG. 4 thereby retaining the metal parts 5 in the housing 2. An electrically conductive contact is established in this second embodiment in the same manner as discussed previously regarding the first embodiment. Thus, the insulated lead 3 is initially aligned parallel to the longitudinal dimension of the metal part 5 from overhead (i.e. outside the metal part 5). Then, the insulated lead 3 is pressed into the metal part 5 from its overhead position so that the cutting edges 7 cut through the insulation 8 of the insulated lead 3 and make contact with the core 9. In addition, electrically conductive contact with the stripped lead 4 is established similar to the previous embodiment by inserting the stripped lead 4 through the opening 11.

Figure 5:
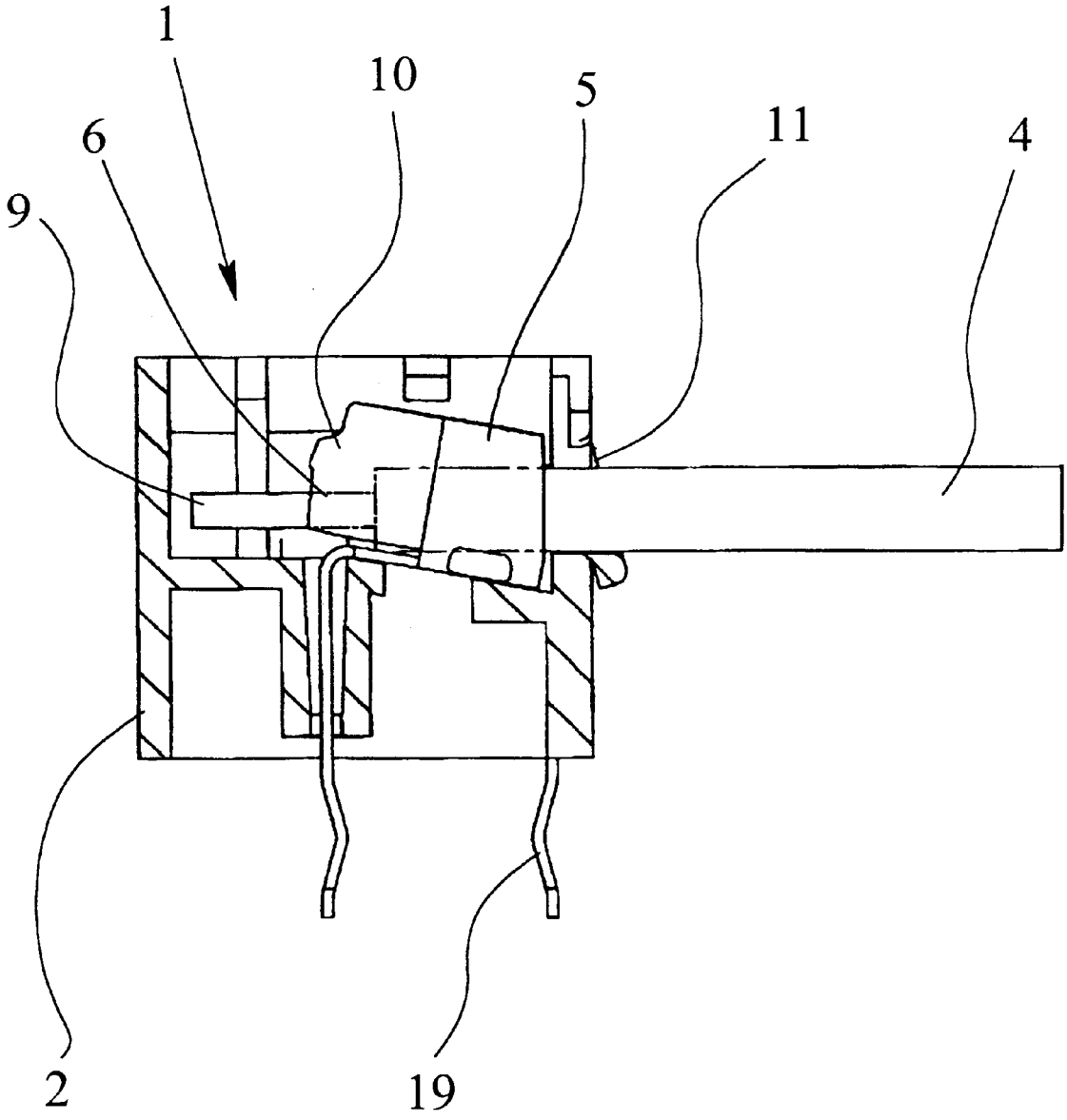
FIG. 5 shows a sectional view of a third embodiment of an electrical connection unit in accordance with the present invention together with a profile view of a stripped lead connected therein.

In the cross-sectional view of yet another embodiment of the electrical connection unit 1 as shown in FIG. 5, the metal part 5 is retained at an acute angle to the longitudinal extension of the stripped lead 4. This oblique positioning of the metal part 5 ensures that the core 9 of the stripped lead 4 which is pushed into the opening 11 of the housing 2 meets the lower, narrower area of the elastic legs 6 which form the contact opening and not the upper part of the elastic legs 6 which forms the entry area 10. As the stripped lead 4 is pressed in further into the housing 2, the oblique position of the contact opening, which is formed by the elastic legs 6, ensures that the core 9 of the lead 4 is pressed into the lower, narrower area of the contact opening.

Figure 6:
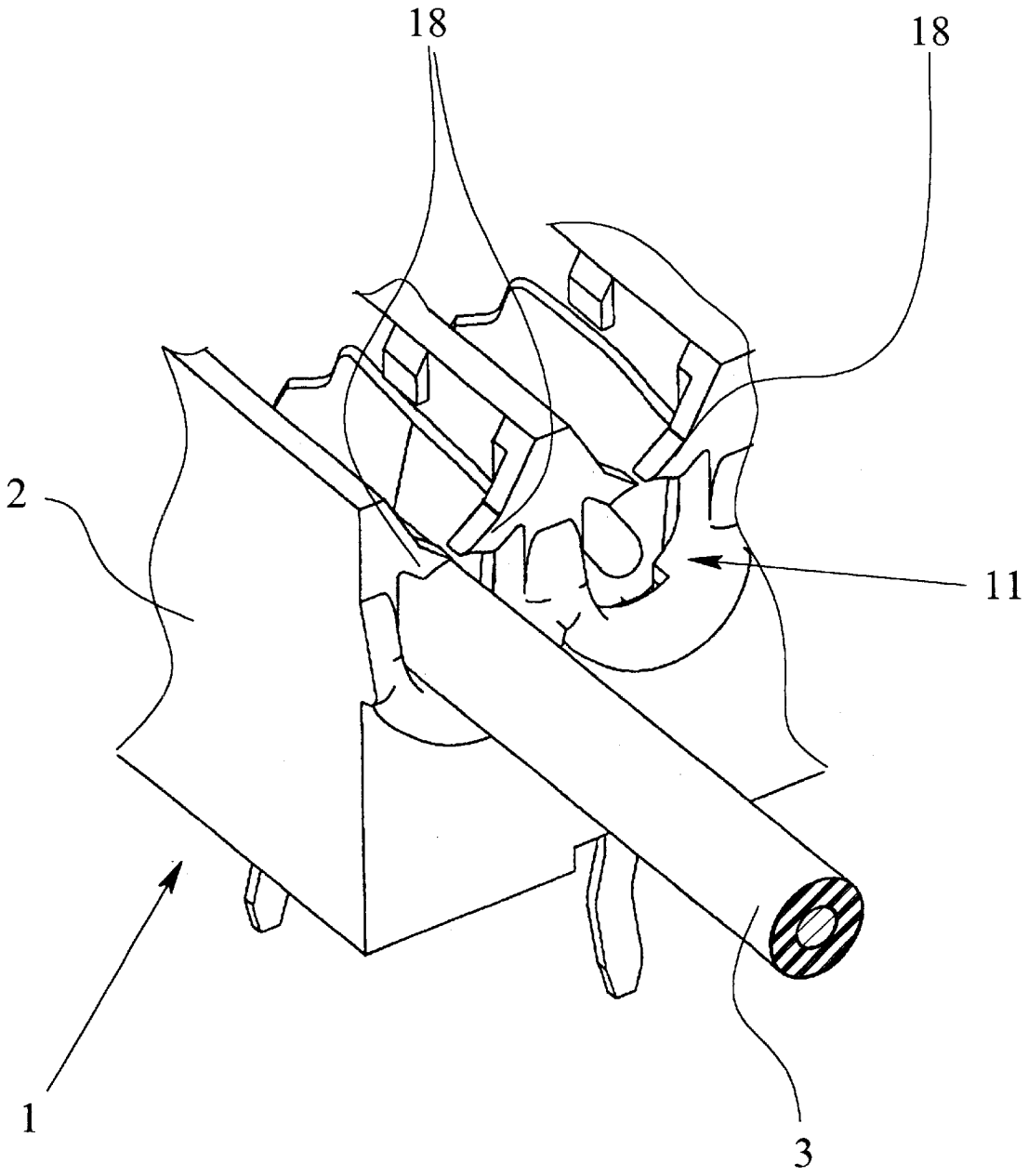
FIG. 6 shows a partial perspective view of a fourth embodiment of an electrical connection unit in accordance with the present invention.
Figure 7:
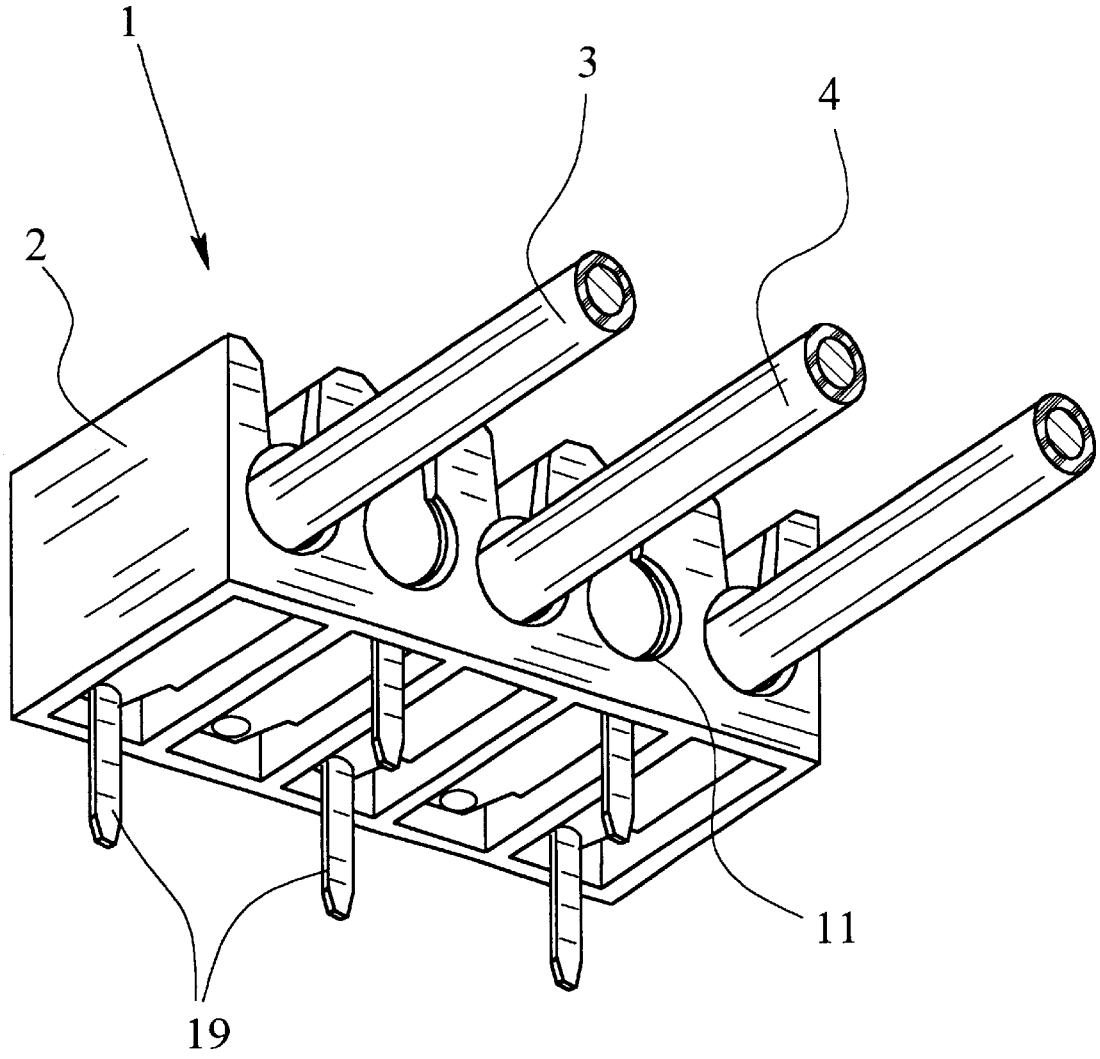
FIG. 7 shows another embodiment of an electrical connection unit in accordance with the present invention, viewed perspectively from below.

In the partially illustrated alternative embodiment of the electrical connection unit 1 of FIG. 6, two catch projections 18 are provided in the housing 2 above the openings 11. The catch projections 18 are made such that they enable a lead such as an insulated lead 3 to be pressed from overhead (i.e. outside the housing 2) into the housing 2, but prevent the insulated lead 3 from unintentionally slipping out of the housing 2 through the top portion of the housing 2. In this regard, the catch projections 18 are made elastic such that whereas they prevent unwanted loosening of the insulated lead 3, they still allow intentional raising of the lead through the top of the housing 2.

As shown in FIGS. 2 and 4 through 9, it is apparent that solder pins 19 can be formed on the metal part 5 to allow the electrical connection unit 1 to be electrically connected to a circuit board (not shown) or other electrical components.

Figure 8:
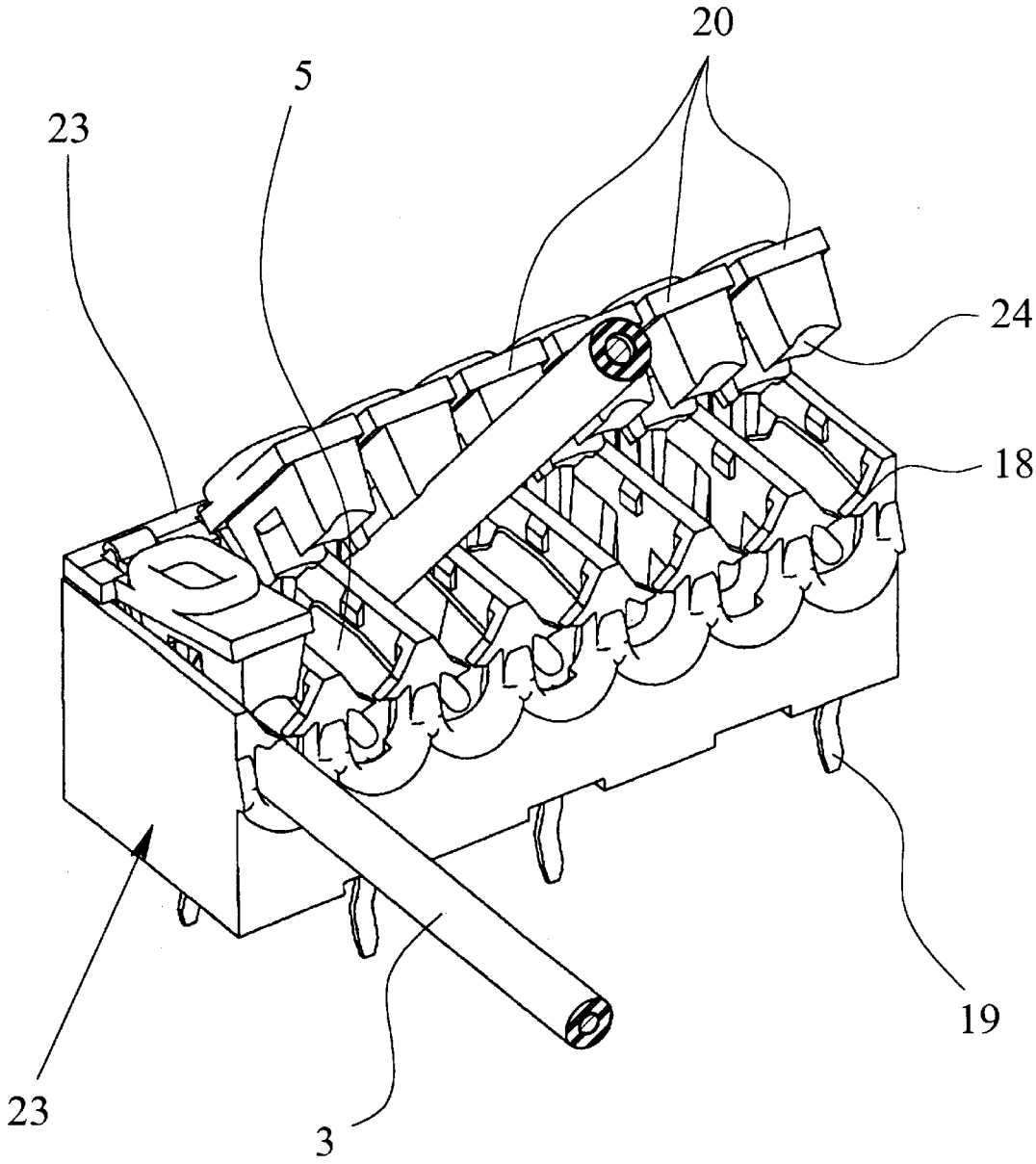
FIG. 8 shows a perspective view of yet another embodiment of an electrical connection unit in accordance with the present invention.
Figure 9:
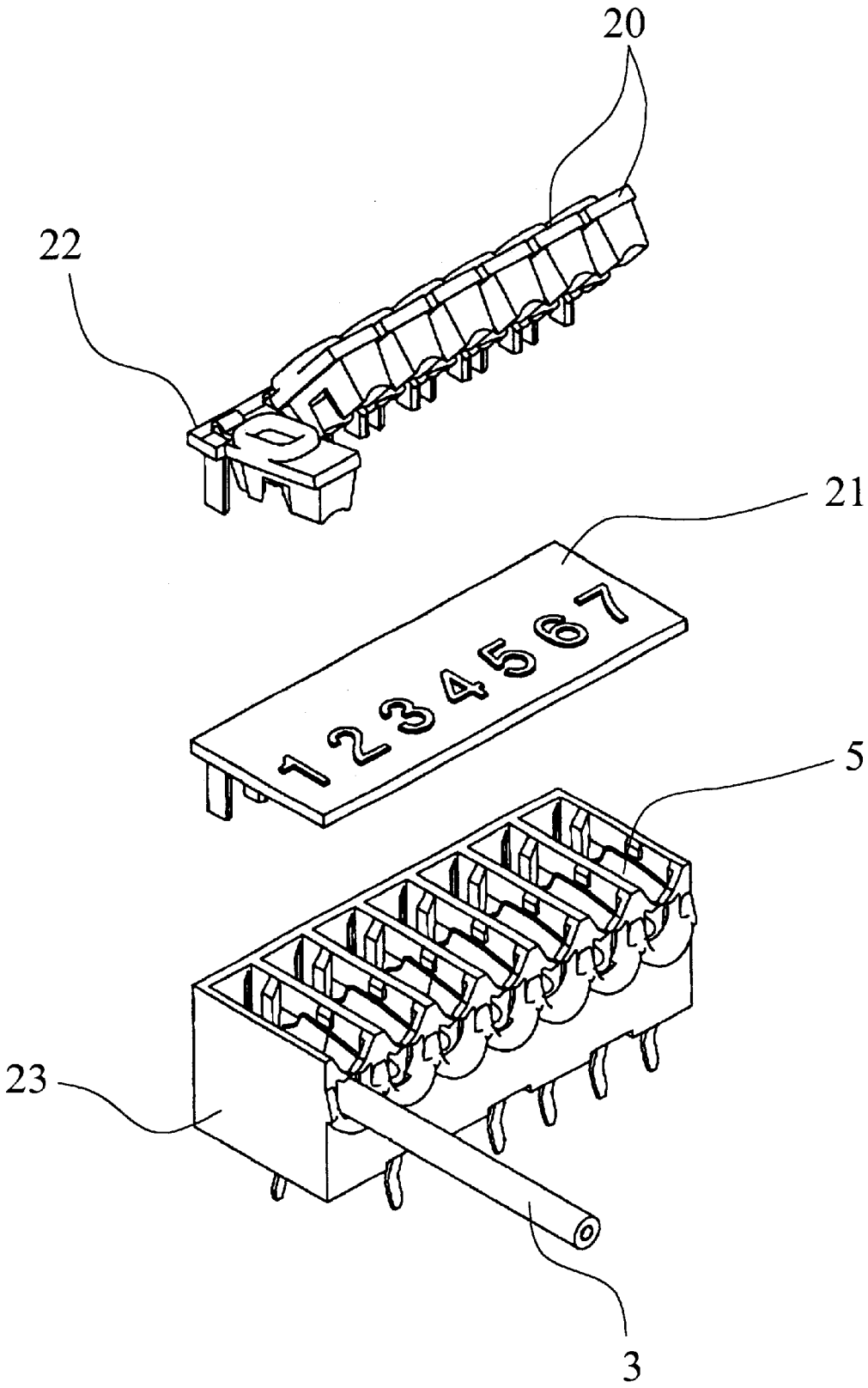
FIG. 9 shows a perspective view of still another embodiment of an electrical connection unit in accordance with the present invention.

As discussed further below, FIGS. 8 and 9 show still other embodiments of an electrical connection units 1 in accordance with the present invention in which the housing 2 can be covered by mounting thrustors 20 or alternatively, by a cover 21 which may include a lettering field. In particular, the mounting thrustors 20 shown in FIG. 8 are provided to cover each terminal of the electrical connection unit 1, each mounting thrustor 20 being jointly arranged to swivel on an attachment beam 22. The attachment beam 22 (with the mounting thrusters 20 swivelled thereon) can be latched from overhead onto a housing block 23 which has numerous terminals which corresponds to the number of mounting thrustors 20, seven terminals in the illustrated embodiment. The individual mounting thrustors 20 may each have a profiled bottom 24 as shown in FIG. 8 which corresponds to the insulated lead 3. In this embodiment of the present invention, electrically conductive contact with the insulated lead 3 is established by first inserting the insulated lead 3 with its tip pointed obliquely downward into the desired terminal behind the cutting edge 7 (shown in FIGS. 2–4). Then, the insulated lead 3 is pressed into the metal part 5 using the mounting thrustor 20 such that the cutting edges 7 cut through the insulation of the insulated lead 3 and make contact with the core 9 in the manner previously described. In FIG. 9, a cover 21 for covering the housing block 23 is also illustrated in addition to the mounting thrusters 20. As previously noted, this cover 21 can have a lettering field so that the individual electrical connection units 1 of the housing block 23 can be easily identified.

From the foregoing description, it should be apparent how the various embodiments of an electric connection unit 1 which are shown in FIGS. 1 to 9 can be used with both insulated leads 3 and stripped leads 4. In addition, it should also be apparent how the various embodiments provide an electrical connection unit 1 which has very small dimensions such that it may be used in confined spaces. Furthermore, it should be clear how the metal part 5 serves a dual function as a cutting element and also as a spring element an electrical connection unit 1 having very small dimensions. Due to the essentially box-shaped configuration of the metal part 5, the metal part can be easily manufactured using various manufacturing techniques such as by stamping and by bending. In addition, the assembling of the entire electrical connection unit 1 can be done very easily and quickly since only the metal part 5 need be installed and retained in the housing 2. Other components used in various other electrical connection units known in the art are unnecessary. The housing 2 may be made of plastic and be produced by injection molding. Of course, as stated previously, different number of terminals together with corresponding openings 11 and metal parts 5 may be provided in the electrical connection unit 1 depending on the application.

While various embodiments in accordance with the present invention have been shown and described, it is understood that the invention is not limited thereto. These embodiments may be changed, modified and farther applied by those skilled in the art. Therefore, this invention is not limited to the details shown and described previously but also includes all such changes and modifications which are encompassed by the appended claims.

We claim:

1. An electrical connection unit comprising:

a housing with at least one terminal having a longitudinal extent for receiving at least one of an insulated lead and a stripped lead; and a metal part received in the housing, said metal part including a longitudinally extending spring element with a cutting element at the end of the spring element, wherein said spring element is adapted to make electrically conductive contact with a stripped lead when a stripped lead is installed in the terminal and said cutting element is adapted to cut through the insulation of the insulated lead and subsequently makes electrically conductive contact with a core of the insulated lead when an insulated lead is installed in the terminal.

2. The unit of claim 1, wherein the spring element is integral to the metal part.

3. The unit of claim 2, wherein the cutting element is integral to the spring element.

4. The unit of claim 1, wherein the metal part is substantially box-shaped.

5. The unit of claim 1, wherein the spring element is a pair of laterally elastic legs.

6. The unit of claim 5, wherein the housing includes an opening for receiving the at least one lead and wherein the pair of laterally elastic legs form a contact opening.

7. The unit of claim 6, wherein said housing includes catch projections which at least partially form said opening.

8. The unit of claim 1, wherein the metal part is received in the housing at an acute angle with respect to the longitudinal extent of the housing.

9. The unit of claim 8, wherein the distal longitudinal extent of the metal part is elevated above the proximal longitudinal extent of the metal part relative to the longitudinal extent of the housing.

10. The unit of claim 1, wherein the metal part further includes at least one catch means for retaining the metal part in the housing.

11. The unit of claim 10, wherein the catch means is a metal clip which is open toward a top side of the housing and which extends perpendicularly to the longitudinal extent of the at least one terminal.

12. The unit of claim 11, wherein the metal clip is adapted to receive the at least one lead.

13. The unit of claim 1, wherein the housing includes inner side walls having attachment crosspieces.

14. The unit of claim 1, further comprising at least one solder pin that is adapted to establish electrical contact between the unit and a circuit board.

15. The unit of claim 1, further comprising a mounting thrustor mounted on the housing.

16. The unit of claim 15, wherein the mounting thrustor is hingeably mounted on a rear wall of the housing.

17. The unit of claim 1, further comprising a latchable cover.

18. The unit of claim 17, wherein the latchable cover includes a field of indicia.

* * * * *